US005180352A

United States Patent [19]

Sreter

[11] Patent Number: 5,180,352

[45] Date of Patent: Jan. 19, 1993

[54] APPLIANCE USED IN EXERCISING THE ARMS AND THE LEGS

[76] Inventor: Change Sreter, No. 451, Ta Tien Road, Homei Chen, Changhua, Taiwan

[21] Appl. No.: 804,405

[22] Filed: Dec. 10, 1991

[51] Int. Cl.[5] ..... A63B 21/075

[52] U.S. Cl. ..... 482/108; 482/1; 482/93

[58] Field of Search ..... 482/1, 2, 3, 8, 9, 44, 482/50, 105, 106, 108, 93, 139

[56] References Cited

U.S. PATENT DOCUMENTS

| | | | |
|---|---|---|---|
| 281,097 | 7/1883 | McGinnis | 482/108 X |
| 310,733 | 1/1885 | Shaw | 482/108 X |
| 593,056 | 11/1897 | Mainhot | 482/108 |
| 768,581 | 8/1904 | Burks et al. | 482/108 X |
| 850,964 | 4/1907 | Pelletier et al. | 482/108 |
| 916,813 | 3/1909 | Whitney | 482/108 |
| 3,488,051 | 1/1970 | Papistas-Scherer | 482/108 |
| 3,734,493 | 5/1973 | Hasekian | 482/108 |
| 4,076,236 | 2/1978 | Ionel | 482/108 |
| 4,351,526 | 9/1982 | Schwartz | 482/108 |
| 5,072,933 | 12/1991 | Diodati | 482/93 |

*Primary Examiner*—Robert Bahr
*Attorney, Agent, or Firm*—Bacon & Thomas

[57] ABSTRACT

An appliance used in exercising the arms and the legs, comprising a grip covered with a protective sleeve and fastened with an adjustable strap for use in exercising the arms, two sockets attached to said grip at two opposite ends to hold two counter weights, two caps covered on said caps to hold two electronic oscillators and two tapered weights, wherein said counter weights each has a bolt hole for fastening a screw rod at either end of said grip; said caps each has an annular groove for fastening a division plate to secure each electronic oscillator in place, and a tapered opening for fastening either tapered weight; said electronic oscillators are triggered to produce sounds by shock waves.

2 Claims, 5 Drawing Sheets

APPLIANCE USED IN EXERCISING THE ARMS AND THE LEGS

BACKGROUND OF THE INVENTION

1. Field of the Invention

The present invention relates to appliances for home or indoor gymnastics and relates more particularly to such an appliance used in exercising the arms and the legs, which can be conveniently adjusted to increase or reduce its total weight according to one's physical condition.

2. Description of the Prior Art

There are known several appliances for home or indoor gymnastics. Among the various exercising appliances dumbbell is one of the most common and economic device used in exercising the arms. Conventionally, a dumbbell is consisted of round weights joined by a short bar, by which it is lifted or swung about in the hand for muscular exercise. This structure of dumbbell has a fixed total weight once it is made. Therefore, different scale of dumbbell shall be used for different volume of training. Further, when a dumbbell drops to the floor or ground, the floor of ground may be damaged by the round weights of the dumbbell easily. There are also disclosed several adjustable dumbbells which can be adjusted to increase or reduce the total weight according to an user's physical condition. The known adjustable dumbbells are generally comprised of a short bar having a plurality of pin holes symmetrically disposed at two opposite ends for releasably fastening different pairs of round weights by lock pins. The common disadvantage of these adjustable dumbbells is that the round weights may oscillate during exercising, causing balancing problem. Another disadvantage of these adjustable dumbbells is that the pins may be broken easily causing the round weights to drop from the short bar, and therefore, exercising accident may happen easily. Further, increase the total weight of a dumbbell simultaneously increase the total size of the dumbbell to make exercising difficult.

SUMMARY OF THE INVENTION

The present invention has been accomplished to eliminate the aforesaid disadvantages and problems. It is therefore an object of the present invention to provide an appliance which can be used in exercising the arms as well as the legs. It is another object of the present invention to provide an appliance which can be conveniently adjusted to increase its total weight without increasing its total size.

According to one aspect of the present invention, there is provided an appliance used in exercising the arms and the legs, which is generally comprised of a grip, two sockets releasably attached thereto at two opposite ends for holding two counter weights, and two caps attached to said sockets for holding two electronic oscillators and two tapered weights respectively, wherein said electronic oscillators are triggered to produce sounds by shock waves; said caps each has a tapered opening for fastening either tapered weights.

According to another aspect of the present invention, the counter weights will oscillate inside the sockets during exercising when the tapered weights are removed from the caps, causing the electronic oscillators to produce sounds.

According to still another aspect of the present invention, the sockets and the caps each has an annular groove on the peripheral surface thereof for fastening a rubber ring which prohibits the appliance from rolling on the ground or eliminates or absorbs shock waves when the appliance hits the ground.

According to still another aspect of the present invention, the grip is covered with a flexible protective sleeve for comfortable and positive grip.

According to a yet further aspect of the present invention, the flexible protective sleeve is attached with an adjustable strap for fastening the grip on an user's hand or leg.

BRIEF DESCRIPTION OF THE DRAWINGS

The foregoing and other objects, features and advantages of the present invention will be best understood from the following description, the appended claims and the accompanying drawings in which:

FIG. 3-A is a side and partly sectional view thereof, showing that the counter weight in either end of the grip is stopped by a tapered weight to eliminate possible shock waves during exercising;

FIG. 3-B illustrates that the strap is adjusted to tightly stretch over the back of the hand which holds the grip; and FIG. 3-C illustrates that the strap is adjusted to tightly stretch over the instep of the leg which stepped on the grip.

DETAILED DESCRIPTION OF THE PREFERRED EMBODIMENT

Figure 1:
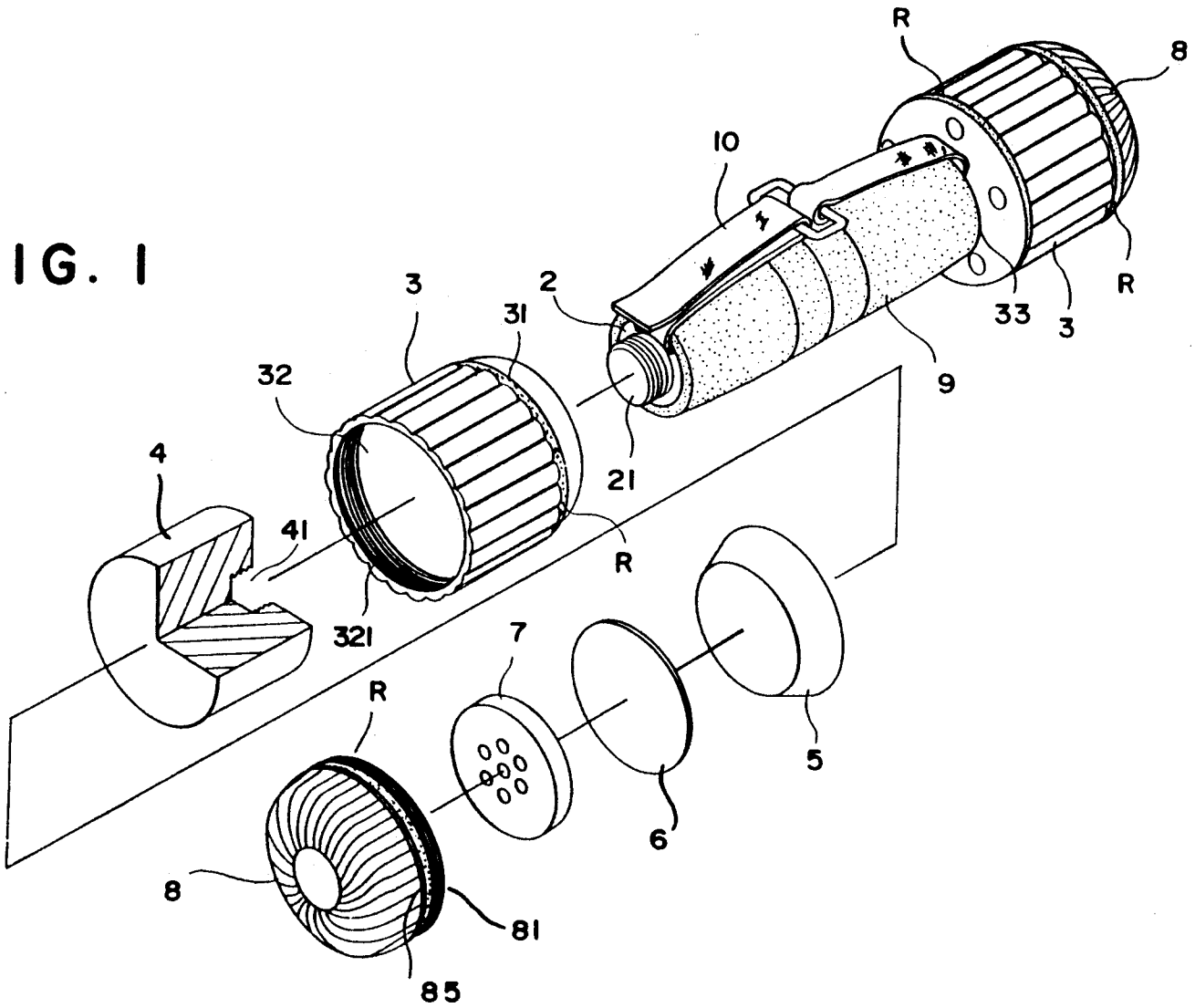
FIG. 1 is an exploded perspective view of the preferred embodiment of the present invention.
Figure 2:
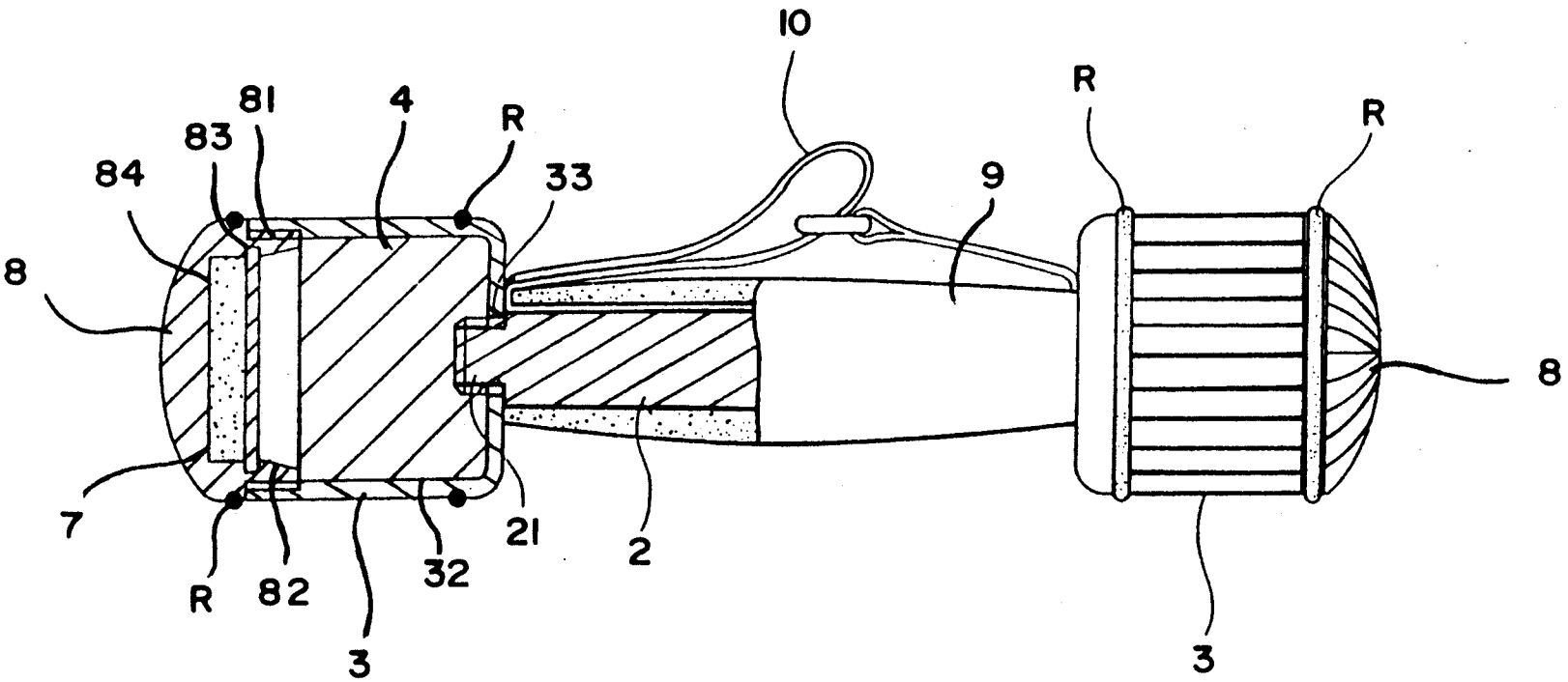
FIG. 2 is a side and partly sectional view thereof.
Figure 3:
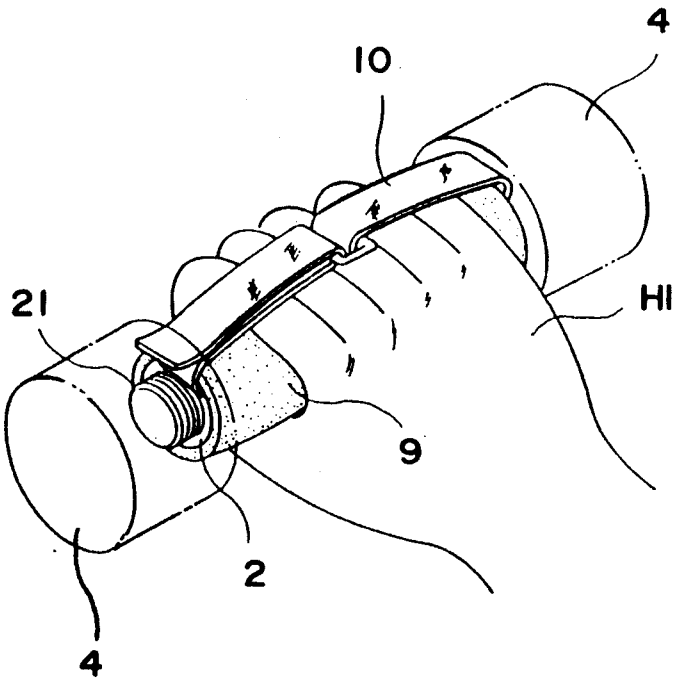
FIG. 3 illustrates that the grip can be independently used in exercising the hand.
Figure 3B:
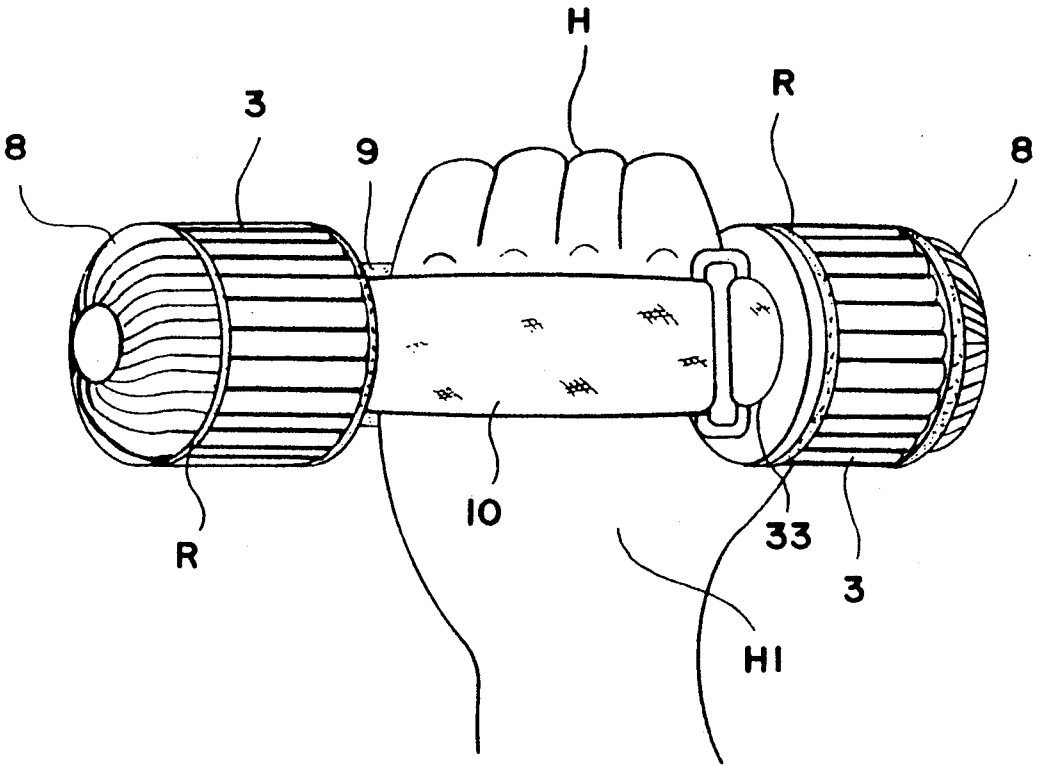
Figure 3A:
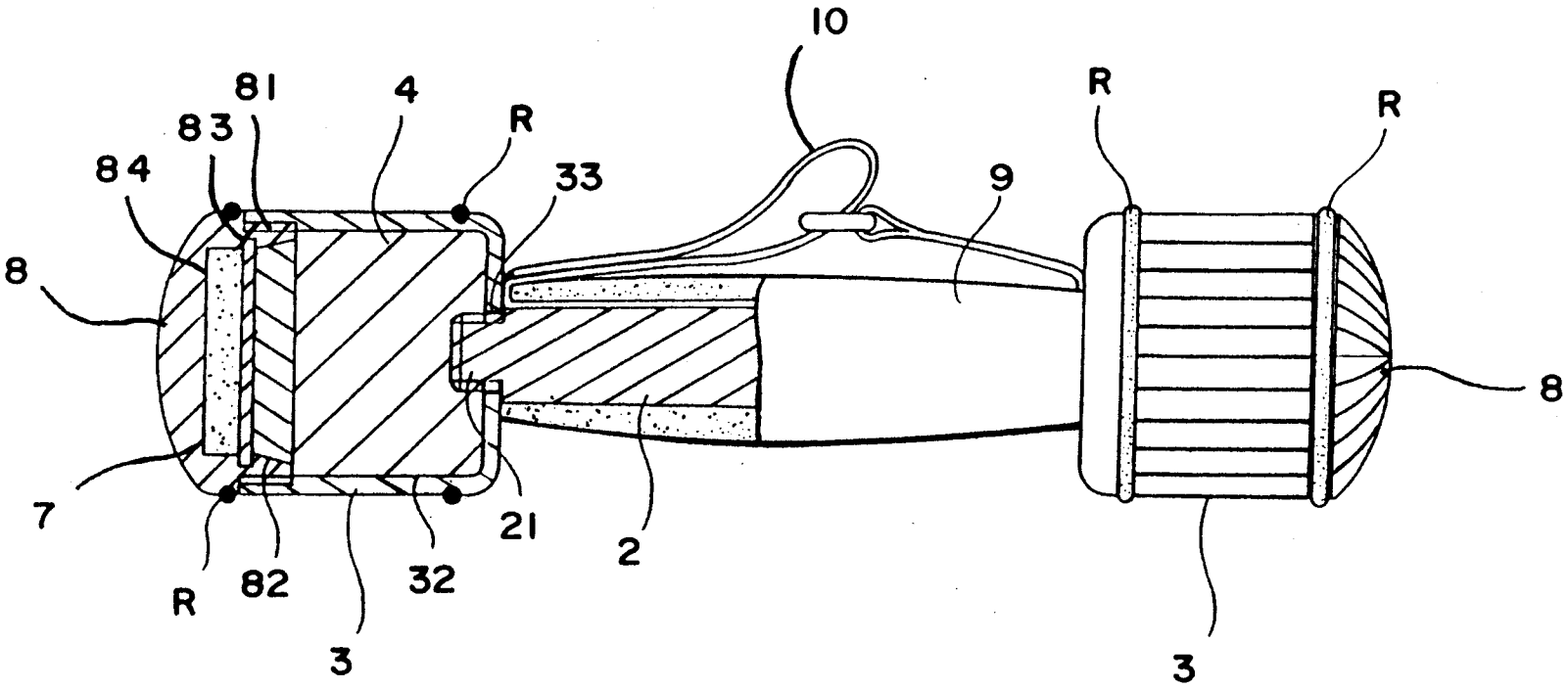
Figure 3C:
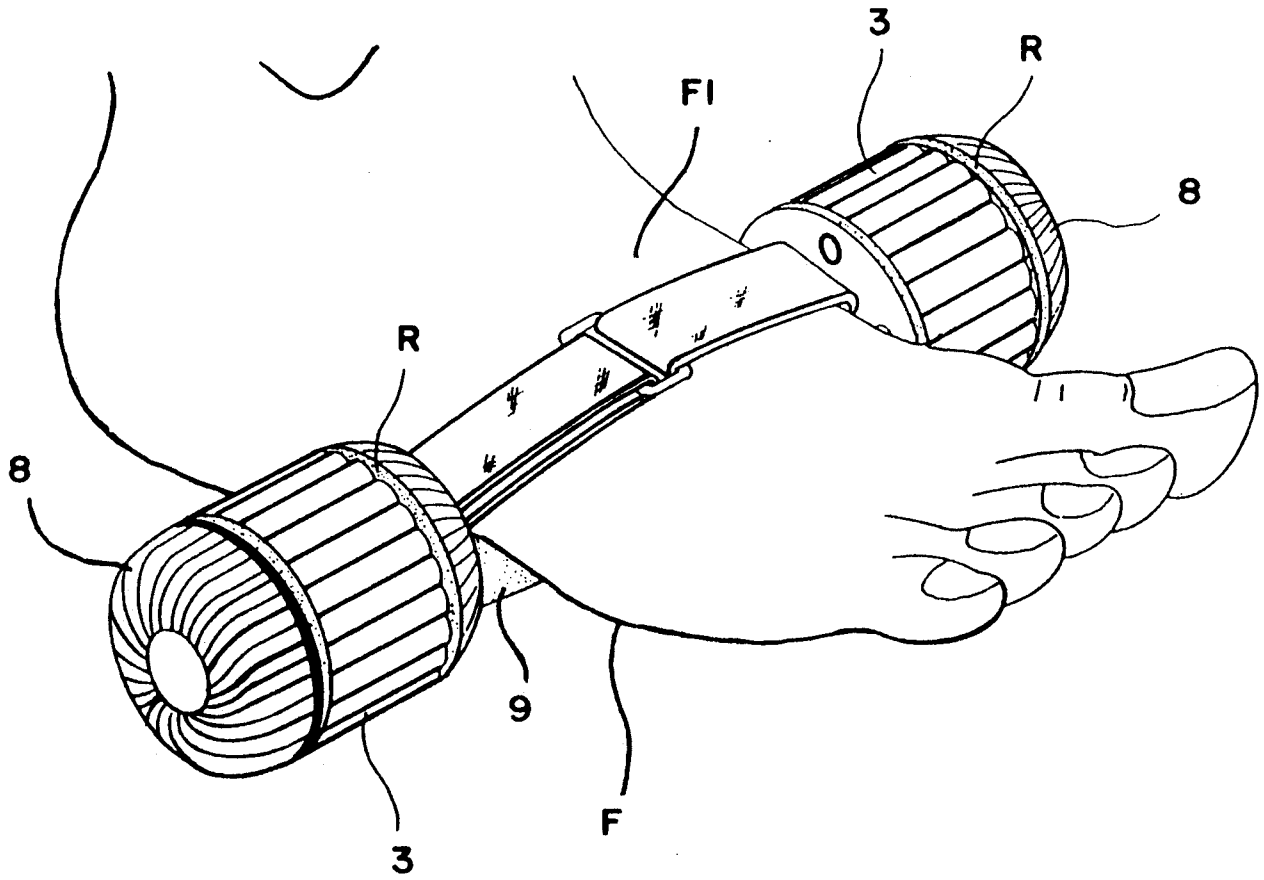

Referring to FIGS. 1, 2 and 3, an exercising appliance as constructed in accordance with the present invention is generally comprised of a grip 2, two sockets 3, two counter weights 4, two tapered weights 5, two division plates 6, two electronic oscillators 7, two caps 8, a plurality of rubber rings R, a protective sleeves 9, and a strap 10. The grip 2 is made from a solid metal rod having two unitary screw rods 21 at two opposite ends. The sockets 3 are made from a plastic material through the process of injection molding, each of which having an annular groove 31 around the outer surface thereof for fastening a rubber ring R, a round hole 33 through the central axis thereof, and an inner thread 321 at one end of the holding space 32. The counter weights 4 are respectively received inside the holding space 32 of each socket 3, each of which having a bolt hole 41 at one end for fastening either screw rod 21 of the grip 2. (counter weights may be made from any of a variety of materials having different mass but formed in the same shape so that an user can flexibly arrange the total weight of the appliance according to one's physical condition). The caps 8 each has an outer thread 81 around the peripheral edge thereof for engaging the inner thread 321 on either socket 3 to secure each counter weight 4 inside each socket 3, an outer annular groove 85 around the outer surface thereof adjacent to the outer thread 81 for fastening a rubber ring R, a receiving space 84 at the inside for holding either electronic oscillator 7, which produces a sound when shaken, and an inner annular groove 83 around the inner wall surface thereof for fastening either division plate 6 to firmly retain the electronic oscillator 7 in place. As indicated, the rubber rings R are respectively mounted on the annular grooves 85, 31 on the caps 8 and the sockets 3. The protective sleeve 9 is made from flexible material covered on the grip 2 for comfortable and positive grip. The strap 10 is adjustable and fastened between the two opposite ends of the protective sleeve 9 (See FIG. 2) for fastening the grip to the hand or the leg. The arrangement of the rubber rings R can protect the appliance against damage.

FIG. 3 illustrates an arrangement according to the present invention, in which the grip 2, the protective sleeve 9 and the strap 10 may be assembled into a device used in exercising the arms. Counter weights 4 may attached to grip 2 at two opposite ends to increase the exercising volume.

FIG. 3-A illustrates an alternate arrangement according to the present invention, in which a tapered weight 5 is fastened in a tapered hole 82 on each cap 8 and squeezed in between the division plate 6 and the counter weight 4 at either end of the grip 2 to increase the total weight of the appliance. In this arrangement, no shock waves will be produced to trigger the electronic oscillator during exercising.

Referring to FIG. 3-B, when the grip 2 is held in the hand H, the strap 10 can be adjusted to tightly stretch over the back H1 of the hand H.

Referring to FIG. 3-C, the present invention can be used in exercising the legs. When a leg F is inserted through the strap 10 with the sole stepped on the grip 2, the strap 10 is adjusted to tightly stretch over the instep F1 of the leg F. Thus, the appliance is used in exercising the legs.

I claim:

1. An appliance used in exercising the arms and the legs, the appliance comprising:

a grip made from a solid metal rod for exercising the arms, said grip having two unitary screw rods at two opposite ends;

a protective sleeve covered over said grip for comfortable and positive grip;

an adjustable strap fastened to said protective sleeve for securing said grip to the leg or the hand;

two sockets respectively made from a plastic material through the process of injection molding and releasably attached to said grip at two opposite ends, said sockets each having an annular groove around the peripheral surface thereof for fastening a rubber ring, a holding space defined therein, a round hole at one end through the central axis thereof for inserting either screw rod of said grip, and an inner thread at an opposite end;

two counter weights respectively received in said two sockets and releasably attached to said grip at two opposite ends, said counter weights each having a bolt hole at one end for fastening either screw rod of said grip;

two caps respectively covered on said two sockets, said caps each having an outer thread at one end, an annular groove around the peripheral surface adjacent to the outer thread thereof for fastening a rubber ring, a receiving space at the inside, an inner annular groove around the inner wall surface thereof, and a tapered opening at one end opposed to the outer thread thereof;

two electronic oscillators respectively received in said receiving space of either cap, said electronic oscillators being triggered to produce sounds by shock waves;

two division plates respectively fastened in the inner annular groove on either cap to firmly retain said electronic oscillators in place; and two tapered weights respectively releasably inserted into said tapered opening of either cap and stopped against either counter weight.

2. The appliance of claim 1 which further comprises at least one pair of supplementary counter weights alternatively fastened in said sockets to replace said counter weight, and at least one pair of supplementary tapered weights alternatively fastened in said tapered opening of either cap to replace said tapered weights, said at least one pair of supplementary counter weights being similar in shape and size but different in mass relative to said counter weight, said at least one pair of supplementary tapered weights being similar in shape and size but different in mass relative to said tapered weight.

* * * * *